United States Patent [19]
Washburn

[11] 4,318,315
[45] Mar. 9, 1982

[54] RATCHET WRENCH WITH RETURN SOCKET

[76] Inventor: James R. Washburn, 3337 N. 62nd St., Scottsdale, Ariz. 85251

[21] Appl. No.: 185,195

[22] Filed: Sep. 8, 1980

[51] Int. Cl.[3] ..... B25B 13/00
[52] U.S. Cl. ..... 81/58.2; 81/121 A
[58] Field of Search ..... 81/58, 58.2, 60, 61, 81/62, 63, 63.1, 63.2, 121 A

[56] References Cited

U.S. PATENT DOCUMENTS

| | | | |
|---|---|---|---|
| 1,890,213 | 12/1932 | Cameron et al. | 81/62 |
| 2,578,686 | 12/1951 | Fish | 81/121 A |
| 2,693,123 | 11/1954 | Fish | 81/58.2 |
| 2,712,256 | 7/1955 | Fish | 81/58.2 |
| 2,851,914 | 9/1958 | Zeckzer | 81/58.2 |

*Primary Examiner*—James L. Jones, Jr.
*Attorney, Agent, or Firm*—Gregory J. Nelson

[57] ABSTRACT

A split socket ratchet wrench is provided. The wrench has an elongate handle terminating at jaws at the head end of the wrench. The jaws receive a rotatable split socket and ratchet wheel rotatable therein. A manually actuable pawl has extending projections engageable with the ratchet teeth. A separate cable spool at the handle end of the wrench is fitted with a torsion spring. A cable or filament extends between the cable spool and the ratchet wheel. As the socket is rotated, it carries with it the cable which is spooled around a hub of the socket. When the wrench is disengaged from the nut, the pawl can be released and the cable spool will rewind returning the socket to the normal "open" position at which point a registry stop on the socket prevents the socket from rewinding past the open position. A separate locking device senses when the cable spool is completely payed out and prevents the mechanic from further turning the socket.

5 Claims, 13 Drawing Figures

FIG. 4
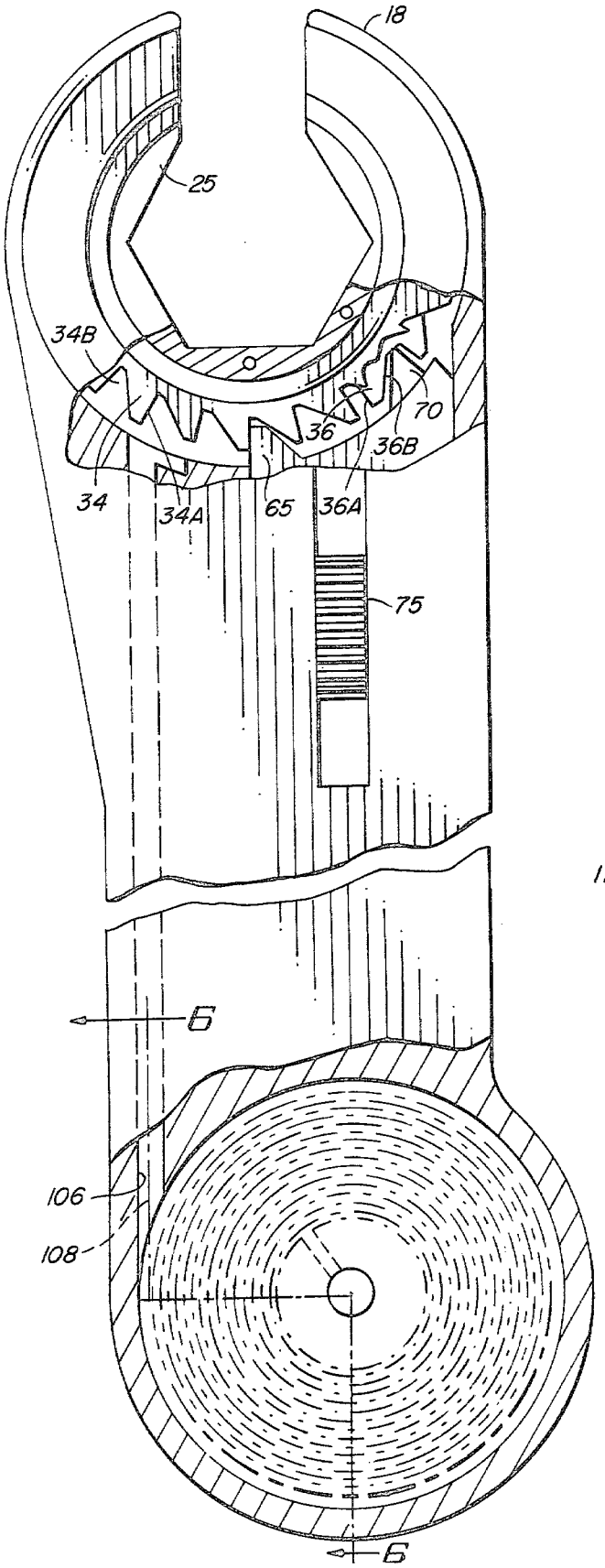
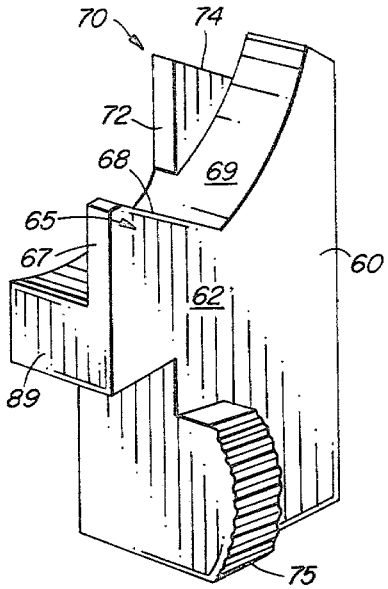
FIG. 5
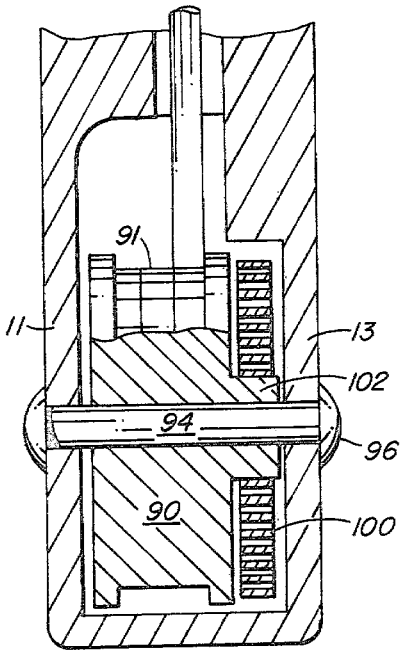
FIG. 6

RATCHET WRENCH WITH RETURN SOCKET

This invention relates generally to tools, and more particularly to open-end split socket wrenches having direct nut engaging portion and a socket return.

Open end or split socket ratchet wrenches are known in the art and are characterized by a number of disadvantages which limit their usefulness and acceptability. Among these features are a lack of compactness making these wrenches impractical for use in limited working spaces. Further, wrenches of this type are often of complicated design which renders them unnecessarily high in initial cost limiting sales and acceptance.

Further, conventional ratchet wrenches are not practical for certain applications such as tubing work in gas plumbing since closed ratchet wrenches cannot be inserted over the tubing. Several open-type ratchet wrenches can be found in the prior art. For example, U.S. Pat. Nos. 2,712,256 and 2,578,686 to Fish, show open-sided ratchet wrenches which are useable with continued pipe systems and can be slipped over the nut. However, a problem arises in the use of such open-sided ratchet wrenches when applied to nuts on tubing and other continuous piping systems. As the nut is rotated, the socket is rotatively displaced relative to the jaws of the wrench. At the completion of the work cycle, the rotatable socket may not be aligned with the jaws of the wrench. Thus, while the wrench may be axially moved off of the nut, the wrench cannot be disengaged from the tubing or conduit without manually returning the socket to the original aligned, open position.

Accordingly, there exists a need in the art for an improved wrench of the ratchet-type which can be used in limited working spaces, particularly adaptable for working on continuous tubing or conduit systems and which has provision for returning the wrench socket to the open position.

Briefly, in accordance with the present invention, an open-sided socket ratchet wrench is provided with a body having a handle portion and a head. The head has arcuate jaws defining an opening and accomodating a rotatable split socket which includes openings to the work engaging faces which align in the open position. The socket includes an interior spool portion. A flexible cable or line is attached to the spool portion and extends through a channel or passageway in the wrench handle terminating at a cable spool which is fitted with a torsion spring which serves to store excess line and keep a constant tension on the line at all times. The line is attached to the socket by a small pinned hinge which swings outwardly from the socket to stop rotation of the socket when the socket becomes completely unwound.

The socket is provided with a pair of ratchet wheels each having ratchet teeth around their periphery except at the open portion. A pawl having two pawl teeth engageable with the ratchet is manually actuable. Upon release of the pawl, the energy stored in the cable spool will allow the socket to unwind to return to the initial open position.

In a further aspect of the present invention, a cable sensor is cooperative with the line to trip a lock mechanism when the cable spool is fully unwound to prevent over-stressing the cable.

The device of the present invention offers several advantages in that it can be inserted over continuous tubing or conduit system and then can be axially moved over a nut on the conduit or tubing. The nut can be tightened or removed as with an ordinary ratchet wrench and upon axially sliding device off the flare nut, the socket can be quickly rewound to the initial open position by disengagement of the pawl from the ratchet teeth.

The above and other objects and advantages of the present invention will become more apparent from the following description, claims and drawings in which:

FIG. 4 is a top plan view of the wrench of the present invention partly broken away;

FIG. 5 is a perspective view of the pawl;

FIG. 6 is a sectional view taken along lines 6—6 of FIG. 4;

Figure 1:
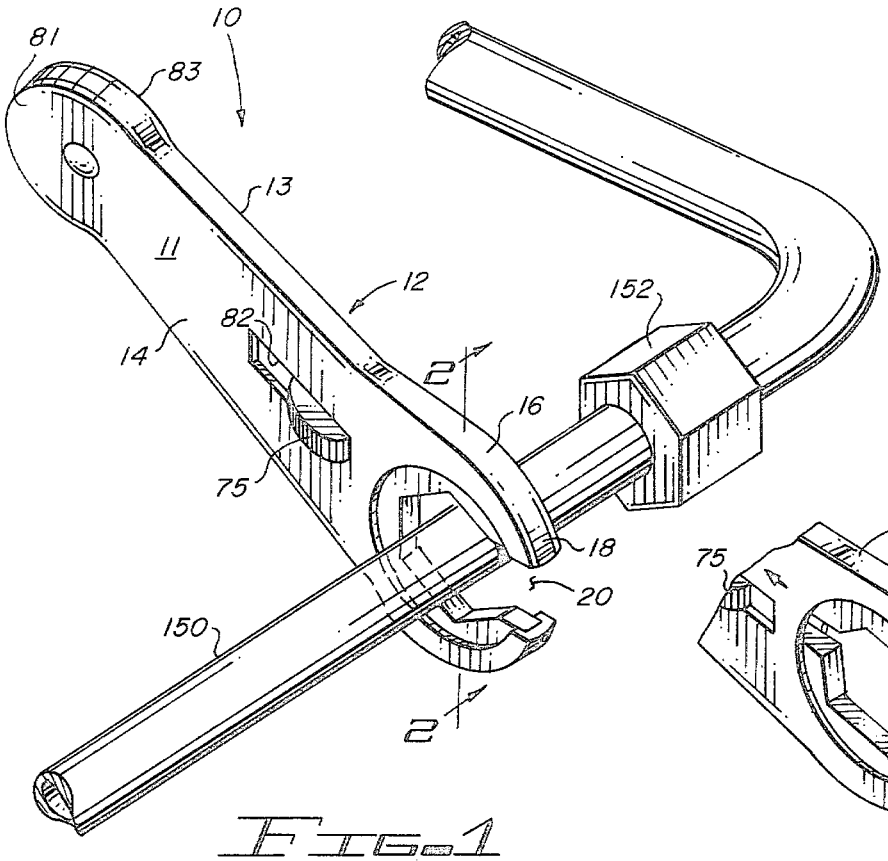
FIGS. 1 and 1A are perspective views showing the wrench of the present invention.

Referring now to the drawings, the wrench of the present invention is generally designated by the numeral 10 having a body 12 with front side 11 and rear side 13. Body 12 has an elongate handle portion 14 and an upper head 16 including a pair of arcuate jaws 18 defining an opening 20 therebetween.

Figure 2:
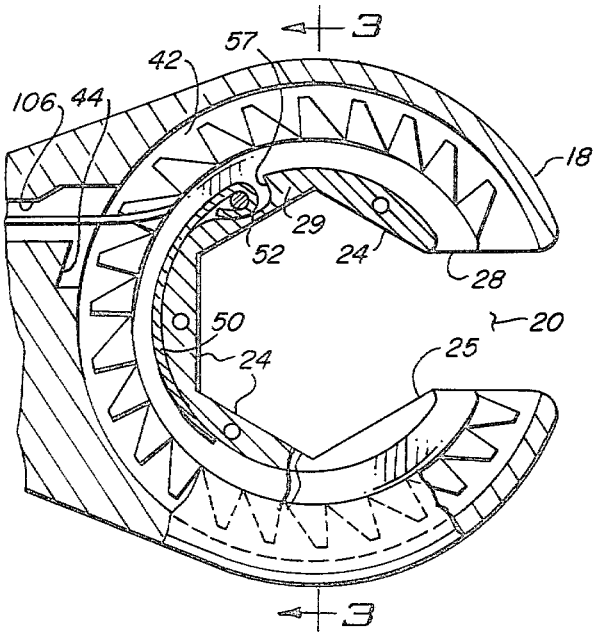
FIG. 2 is a sectional view of the head of the wrench taken along lines 2—2 of FIG. 1.
Figure 3:
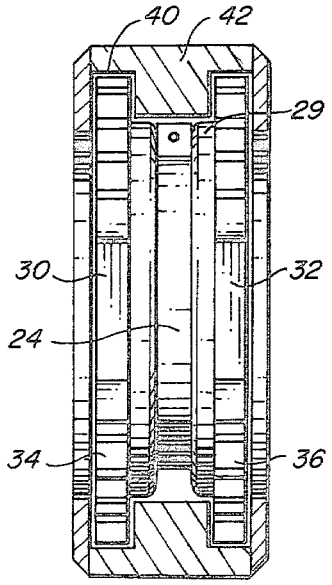
FIG. 3 is a sectional view taken along lines 3—3 of FIG. 2.

As best seen in FIGS. 2 and 3, a split socket 25 is rotatively housed within jaws 18 having work engaging faces 24 which are shown as cooperative with a hexagonal fitting but may be any desired configuration. Split socket 25 defines an opening or aperture 28 which permits access to the faces 28 ad which, in the open position, align with opening 20 in jaws 18. Socket 25 includes an intermediate hub 29 interposed between ratchet wheels 30 and 32. Ratchet wheel 30 is provided with a plurality of peripherally extending ratchet teeth 34. The profile of teeth 34 is best shown in FIG. 4 having a forward surface 34A which is generally radial and a rear surface 34B forming a generally acute angle with respect to surface 34A.

Teeth 36 are oppositely disposed on wheel 32 with respect to teeth 34 having a radial surface 36A and a rear surface 36B. Also it is to be noted that the row of ratchet teeth 36 is arranged between the rows of ratchet teeth 34. Jaws 18 are provided with recesses 40 to receive the ratchet teeth 34 and 36 and allow rotation of the spool with the jaws but to prevent axial displacement of the spool.

Intermediate hub 29 has a diameter less than the ratchet wheels 30 and 32 and a land portion 42 of the jaws extends radially inward between the ratchet plates. A portion of the annular land 42 is notched at 44 to engage arcuate stop member 50 when the spool is fully unwound.

As best seen in FIGS. 2, 9A, 9B and 10, arcuate stop member 50 is hingedly secured to the hub 29 at pin 52 at clevis 56. Hub 29 is contoured having a recess 57 to receive stop 50. A slot 59 is provided in the stop 50 for attachment of a cable or line as will be more fully explained hereafter.

Pawl 60, as best seen in FIGS. 4 and 5, is axially slidable within rectangular cavity 64 and body 12. Pawl 60 has a rectangular body 62 having an upper generally arcuate edge 69 having a radius conforming to the radius of the ratchet wheels 30 and 32. A first tooth projection 65 is adapted to engage ratchet wheel 30 having a vertical edge 67 and angular edge 68 conforming to the faces 34A and 34B respectively of teeth of ratchet wheel 30. The width of projection 65 does not extend the full width of the pawl body but generally corresponds in width to the teeth 34 on ratchet wheel 30.

Similarly, a second pawl projection 70 extends from the opposite edge of the pawl body and is laterally spaced apart from projection 65 adapted to align with ratchet wheel 32. Pawl projection 70 has a generally vertical edge 72 and an angular edge 74 which conforms to the faces 36A and 36B of teeth 36. Pawl teeth 65 and 70 are circumferentially spaced apart a distance greater than the jaw opening 20 so at least one of the ratchet wheels 30 and 32 will be engaged in all rotative positions of the split socket. A lug 75 projects from the face and body 62 through an opening 83 in the front cover plate 11 of the wrench.

Figure 7:
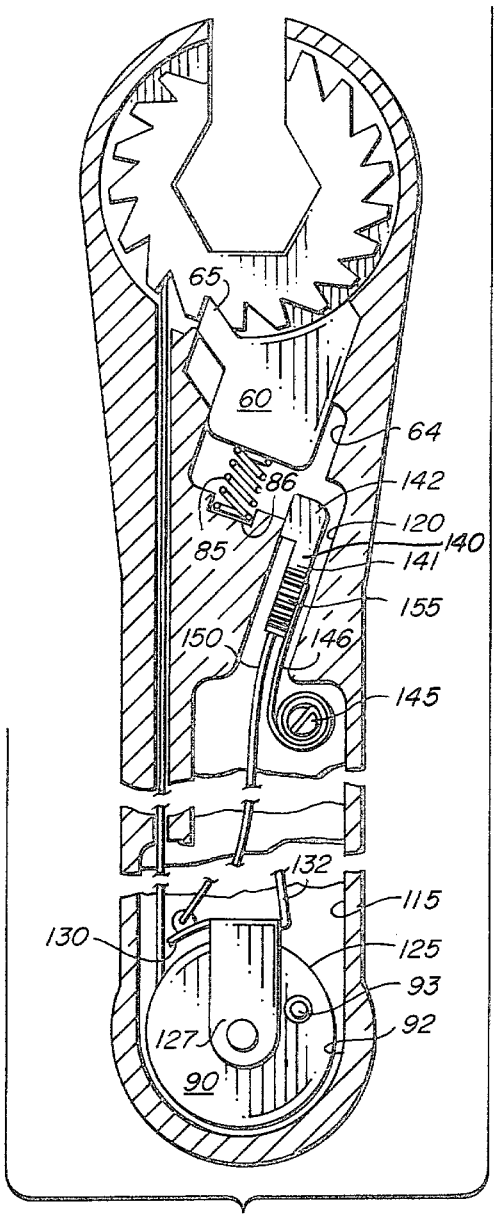
FIG. 7 is a top plan view broken away showing the wrench in an open position.
Figure 8:
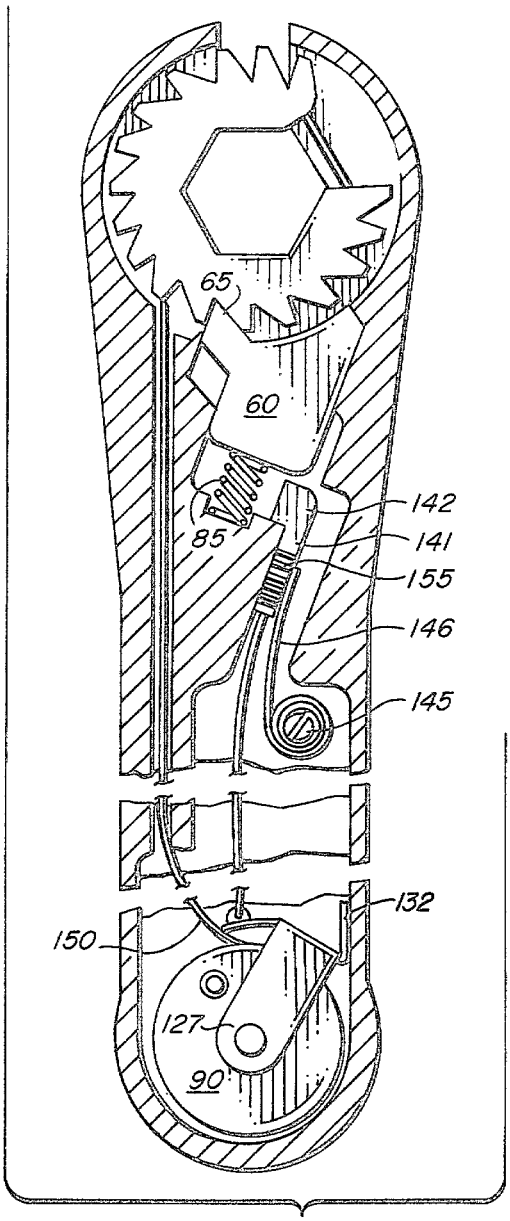
FIG. 8 is a top plan view broken away showing the wrench with the spool in a fully wound position.
Figure 9A:
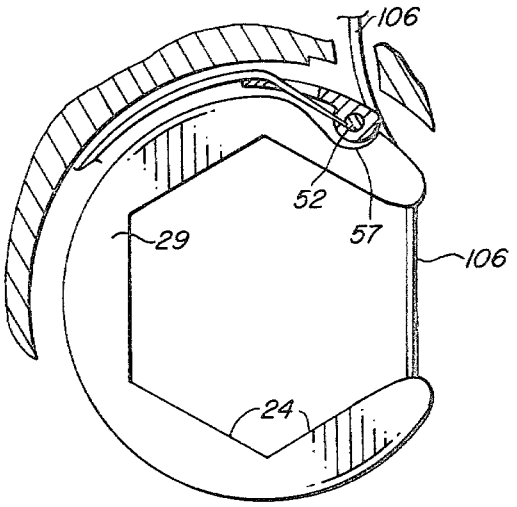
FIGS. 9A and 9B illustrate the spool stop mechanism.
Figure 9B:
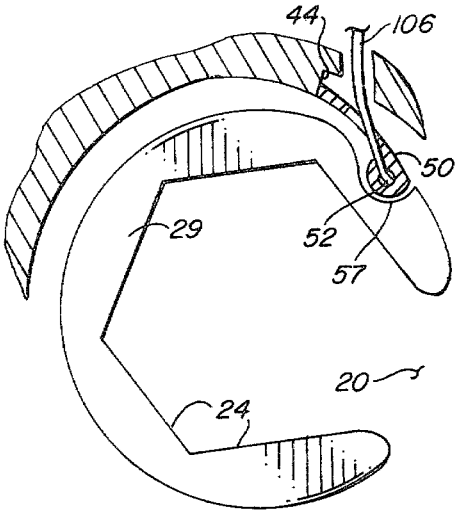
Figure 10:
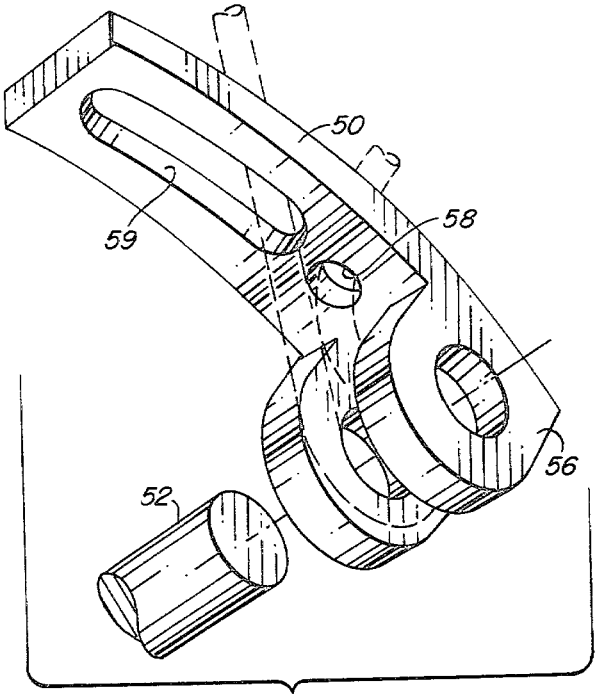
FIG. 10 is a detail perspective view of the leaf stop.
Figure 11:
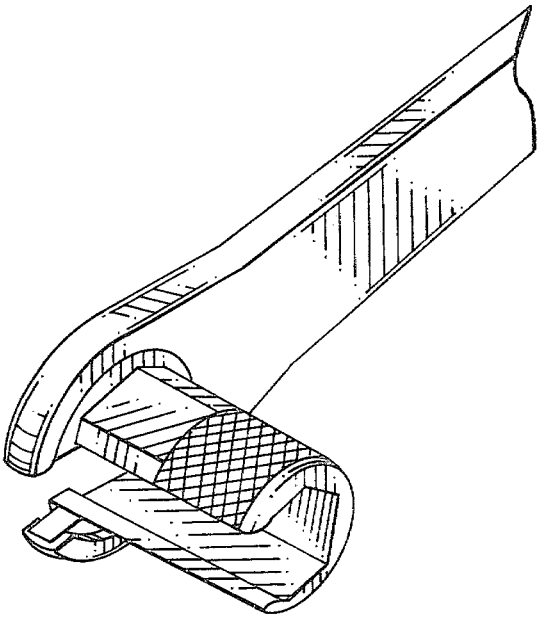
FIG. 11 is a perspective view illustrating a removable socket in connection with the wrench of the present invention.

As best seen in FIGS. 4, 7 and 8, pawl 60 is longitudinally slidable in cavity 64 in the wrench body. A biasing spring 84 extends axially within cavity 64 having one end in recess 86 of the wrench body and the other recess in shoulder 89 of the pawl body. Thus, the pawl is normally biased to the position shown in FIG. 4 with projections 65 and 70 engaging ratchet wheels 30 and 32 respectively.

Referring to FIGS. 4 and 6 to 8, return spool 90 is rotatable within cylindrical cavity 92 in the lower end of wrench body 12. Spool 90 is mounted for rotation on shaft 94 extending axially through the cavity 92 and secured at opposite sides 11 and 13 by rivets 96. Spool 90 is provided with a plurality of circumferential grooves 91 to maintain cable wound about the spool in an orderly fashion. A torsional clock spring 100 is secured to axial projection 102 of spool 90. As spool 90 is wound in the clockwise position as shown in FIG. 4, torsional spring 100 will store energy.

A cable passage 106 connects cavity 92, intercepting cavity 92 tangentially as seen in FIG. 4. A flexible cable or filament 108 such as monofilament line is secured to the registration stop 50 through slot 59 and secured at hole 58 with the opposite end being secured at the interior of spool 90 at hole 93. In the open position, as shown in FIG. 4, opening 20 in the socket 25 aligns with the opening 20 in the jaws 18 and cable 108 is fully wound about the cable spool 90. In this position, the torsional spring 100 is relaxed. Registration stop 50 engages recess 44 in the open position. As the socket is rotated within jaws 18, cable or line 108 will be payed out and transferred to spool hub 29 as will be more fully explained hereafter.

The wrench of the present invention is further provided with a locking mechanism to prevent the mechanic from applying torque to the wrench when the cable spool is fully unwound. In FIGS. 7 and 8, the locking mechanism is shown. In these views, the back cover plate 13 of the wrench has been omitted for clarity. The wrench body defines an interior chamber 115 communicating with the return cable spool chamber 92. Passageway 120 connects chamber 115 with cavity 64 which slideably receives the pawl 60. Cable sensing mechanism 125 is engaged when the cable is fully payed out. Cable sensing mechanism 125 includes pivot link 127 pivotally secured to axial shaft 94. Pivot link 127 has a projecting ear 130 which extends in close proximity to cable 108 except when cable 108 is fully payed out. A generally vertical stop member 132 projects from the opposite edge of pivot link 127 to engage the interior wall of cavity 115 as will be explained.

In FIG. 7, slide 140 is shown positioned within channel 120 in the non-actuated position. Slide 140 has an elongate body portion 141 and a shoulder 142 extending generally at right angles with respect to body 141. Clock spring 145 is secured within cavity 115 and has a leaf member 146 secured to the body 141 of the stop member. It will be observed that clock spring 145 urges or biases the slide 141 generally downward and to the left as viewed in FIG. 7. An actuating link 150 connects pivot link 127 with slide 140. In the normal position, as seen in FIG. 7, the slide 140 occupies a position clear of pawl 60. Therefore, pawl 60 can be disengaged or moved out of registry with the ratchet plates 30 and 32. However, when stop 140 assumes the position shown in FIG. 8, shoulder 142 will engage the underside of the body 62 of the pawl 60 preventing downward displacement of the pawl. The stop 140 can be moved manually out of the locked position by projection 155 extending through the back plate 83.

The wrench of the present invention will be more fully understood from the following description of operation and use.

The wrench body may be configured in various shapes to give the proper "feel" and weight distribution. The recessed body of the wrench is closed and completed by front and rear cover plates 81 and 83 conformed to the shape of the wrench handle. The cover plates may be permanently removed and secured to the side walls or a portion of the wrench body may be suitably cast. The wrench may be made from various materials such as a suitable quality tool steel.

Figure 1A:
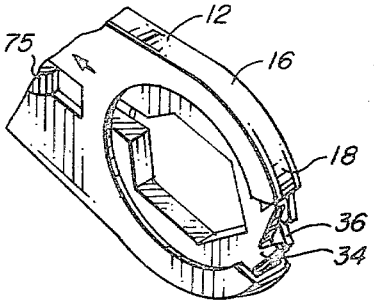

In use, the wrench of the present invention is typically positioned over a continuous tube or conduit system as shown in FIG. 1. Wrench 10 is then moved axially along the pipe 150 and slipped over the flare nut 152 as best seen in FIG. 1A. The mechanic can then apply a loosening or tightening torque to the wrench. As shown in FIGS. 1 and 1A, the wrench is positioned to tighten flare nut 152 by applying clockwise rotation to the nut. The pawl projections 65 and 70 are maintained in engagement with the teeth of the ratchet wheels 30 and 32 by biasing spring 185. When the wrench is rotated until the handle or body 12 engages abutment 160, the pawl is moved downwardly by means of lug 75. The shape of the teeth and the interrelationship with the teeth of the ratchet wheel permit easy disengagement without interference. If the nut is extremely loose, the pawl may have to be manually disengaged from the ratchet wheel; otherwise the wrench will operate similar to a conventional ratchet with the pawl being "kicked" out of engagement. This operation is repeated until the nut 152 is sufficiently tightened. During rotation of the socket relative to the jaws of the wrench, it is to be noted that cable 108 has been displaced from the cable spool 90 and has been caused to be wound about the hub of the socket as seen in FIG. 1A.

In the event the mechanic attempts to apply torque after the entire length of cable 108 has been wound from the cable spool 90, such operation will be prevented by the locking mechanism. Once the cable 108 has been entirely unwound from the cable spool, the cable will pay out and assume a position as shown in FIG. 8. This will bring the cable 108 into engagement with the contact tab 130 of the cable sensor device 125. The cable sensor device 125 will be pivoted to the position shown in FIG. 8 with stop 132 engaging the wall of cavity 115 to prevent "knee locking" of the linkage 150. The rotation of the cable sensor will displace the stop 140 upwardly through actuator 150 until shoulder 142 engages the bottom of the pawl cavity preventing any appreciable downward movement of the pawl 60 thus locking the wrench. To unlock the wrench, the mechanic must move the stop out of position by shifting lug 155 to the right and downwardly as viewed in FIG. 8.

Once the nut 152 has been sufficiently tightened, the wrench is returned to the position shown in FIG. 1 and pawl 60 moved downwardly. Since the wrench has been disengaged from the nut, disengagement of the pawl 60 from the ratchet wheels will allow the spring energy stored in the torsional cable 100 to rewind spool 90 in a clockwise position as viewed in FIG. 4. The rewinding of the clock spring will, in turn, rotate the ratchet wheel until hinged registry stop 50 engages notch 58 in the jaws. This occurs when the opening or gap 20 in the jaws is in alignment with the access opening 28 in the split socket 125.

Reversability of the wrench of the present invention is easily accomplished by simply turning the wrench 180° about its longitudinal axis. Thus, the wrench of the present invention can be used with either right or left hand threads or for tightening or loosening nuts without requiring any change or reversability of the ratchet mechanism.

FIG. 9 shows another aspect of the present invention with the provision of an open snap-in socket 170 having a base 172 with detent 175 conforming to the hexagonal opening 24 in the socket. The snap-in socket is to be provided in different sizes and are interchangeable much like an ordinary drive set. This allows the ratchet wrench of the present invention to be used either as an open split socket wrench or as a conventional socket with interchangeability.

Thus, the wrench of the present invention is an improved wrench which can be used with particular advantage in continuous pipe or conduit systems. The wrench of the present invention requires only a minimum of space during the turning operation and is simple to use and can be manufactured at reasonable cost. The wrench of the present invention is insertable over tubing, then can be inserted over a flare nut, the flare nut tightened and removed as with an ordinary wrench. Upon sliding the device axially off the flare nut, the socket can quickly be rewound to the initial open position.

While there is shown and described the preferred embodiment of the wrench of the present invention, it is understood that various changes, modifications in the size, materials and structure can be made by those skilled in the art without departing from the spirit and scope of the following appended claims.

I claim:

1. A split socket wrench comprising:

(a) a body having a handle portion and forward jaws defining an aperture;

(b) a socket drive member rotative within said jaws having a work engaging surface and defining an opening to said work engaging surface aligned with said aperture in an open position;

(c) said socket member further including ratchet wheel means associated therewith and a hub extending circumferentially around said work engaging surface;

(d) pawl means selectively engageable with said ratchet wheel to selectively restrain or permit rotation of said socket member relative to said jaws;

(e) take-up means in said body and including energy storage means coupled thereto to store energy as the take-up means is actuated; and (f) cable means extending between said socket hub and said take-up means which is payed out and wound about said hub as the wrench is turned in a first direction and which is rewindable in an opposite direction of rotation by said energy storage means when said pawl is released thereby returning said socket member to the open position.

2. The split socket wrench of claim 1 further including stop means actuated by said cable at said hub preventing rewinding of said socket past the open position.

3. The split socket wrench of claim 1 further including lock means restricting pawl actuation when the cable is fully payed out from said cable spool.

4. The split socket of claim 1 further including drive means detachably securable to said socket drive.

5. A split socket wrench for turning nuts on a continuous piping system, said wrench comprising:

(a) a body having a handle portion and forward jaws defining an aperture therein;

(b) a socket drive member rotative within said jaws having a work engaging surface and defining an opening to said work engaging surface aligned with said aperture in an open position;

(c) said socket member further including a pair of ratchet wheel means and an intermediate hub extending circumferentially around said work engaging surface;

(d) pawl means selectively engageable with said ratchet wheel means to selectively restrain or permit rotation of said socket member relative to said jaws, said pawl means having teeth therein adapted to engage each of said ratchet wheel means at spacedapart location greater than the width of said aperture at said jaws;

(e) cable spool means in said body and including energy storage means coupled thereto to store energy as the cable spool is unwound in the direction of rotation;

(f) register stop means pivotally connected to said socket member hub and engageable with the said wrench body to prevent rewinding of the said socket member past the open position; and (g) cable means extending between said register stop and said cable spool means which cable means is payed out and wound about said hub as said wrench is turned in a first direction of rotation and which is rewindable in an opposite direction of rotation by said energy storage means thereby returning the socket member to the open position with said register stop engaged.

* * * * *